US005839020A

United States Patent [19]

Rushing et al.

[11] Patent Number: 5,839,020

[45] Date of Patent: Nov. 17, 1998

[54] METHOD AND APPARATUS FOR CONTROLLING PRODUCTION OF FULL PRODUCTIVITY ACCENT COLOR IMAGE FORMATION

[75] Inventors: Allen J. Rushing, Webster; Matthias H. Regelsberger, Rochester, both of N.Y.

[73] Assignee: Eastman Kodak Company, Rochester, N.Y.

[21] Appl. No.: 799,673

[22] Filed: Feb. 11, 1997

[51] Int. Cl.[6] ..... G03G 15/00

[52] U.S. Cl. ..... 399/49; 399/46

[58] Field of Search ..... 399/38, 46, 47, 399/49, 50, 51, 53, 55

[56] References Cited

U.S. PATENT DOCUMENTS

| | | | |
|---|---|---|---|
| 4,626,096 | 12/1986 | Ohtsuka et al. | 399/49 X |
| 5,001,028 | 3/1991 | Mosehauer et al. . | |
| 5,036,360 | 7/1991 | Paxon et al. | 399/46 |
| 5,253,934 | 10/1993 | Potucek et al. . | |
| 5,257,039 | 10/1993 | Chung et al. . | |
| 5,266,997 | 11/1993 | Nakane et al. | 399/49 |
| 5,300,960 | 4/1994 | Pham et al. . | |
| 5,400,120 | 3/1995 | Narazaki et al. | 399/46 X |
| 5,534,977 | 7/1996 | Saitoh et al. | 399/50 |

OTHER PUBLICATIONS

U.S. application Ser. No. 08/583,732 (Stelter et al).
U.S. application Ser. No. 08/654,953 (Allen).
U.S. application Ser. No. 08/594,955 (Rushing and Regelsberger).
U.S. application Ser. No. 60/002,661 (Rushing).
U.S. application Ser. No. 08/581,025 (Donahue et al).
U.S. application Ser. No. 08/580,263 (Ng al).

*Primary Examiner*—Sandra L. Brase
*Attorney, Agent, or Firm*—Norman Rushefsky

[57] ABSTRACT

A reproduction apparatus and method particularly suited for an electrophotographic DAD-CAD system having an electrostatic recording member for supporting an electrostatic image, a primary charger establishes a primary charge on the member, the primary charge being defined by a parameter $V_o$. An exposure device imagewise modulates the primary charge to form an electrostatic image on the recording member. The device has an exposure parameter $E_o$. A developer station develops the electrostatic image with charged toner. The developer station has an electrical bias to establish a field for urging movement of the toner to the member. The electrical bias has an alternating current component parameter AC and a direct current parameter DC. A controller controls adjustments to the parameters $E_o$, $V_o$ and AC by measuring a density parameter $D_{OUT}$ of an exposed and developed area on the member that is formed by operation of the primary charger, the exposure device and the developer station. The controller includes a calculator for calculating an error, $\Delta D_{OUT}$ in the measured density parameter from a density setpoint and multiplying $\Delta D_{OUT}$ by respective first, second and third constants to obtain respective adjustment values used for adjusting $E_o$, $V_o$ and AC and wherein in repeated use of the controller to provide repeated adjustment values used for adjusting $E_o$, $V_o$ and AC a fixed ratio is maintained between said first, second and third constants. The controller is also suited to providing adjustments to DC using a fourth constant.

29 Claims, 4 Drawing Sheets

METHOD AND APPARATUS FOR CONTROLLING PRODUCTION OF FULL PRODUCTIVITY ACCENT COLOR IMAGE FORMATION

This invention relates to the formation of toner images of two distinct toners, for example, toners of two different colors. More specifically, it relates to an apparatus and method of controlling such image formation.

U.S. Pat. No. 5,001,028 to Mosehauer et al, issued Mar. 19, 1991, is representative of a large number of patents which show the creation of multicolor toner images by creating two unfixed images on a single frame of a photoconductive image member. In creating two or more color images on a single frame, higher productivity in printing of accent color images is possible. Color printers have been marketed using this general approach, using discharged area development (DAD) and electronic exposure for each image.

In the Mosehauer patent the second and subsequent images are toned with a particular toning process using high coercivity carrier and a rotating magnetic core. This process provides a very soft magnetic brush which disturbs the earlier toner images less than an ordinary magnetic brush, even though the brush strands may be allowed to contact the image member.

A few references suggest a mixture of discharged area development and charged area development (DAD and CAD). In a DAD-CAD accent color process, a photoconductive image member is uniformly charged to say a negative potential and is exposed to a DAD image. The DAD image is developed with a toner of a negative potential and a "high resolution development system" which uses about 50 percent of the original voltage on the photoconductor. The image member is then re-exposed to a CAD image with the background portions of the CAD image exposed to about the level of voltage of the first toner image. The CAD image is then developed with positively charged particles.

U.S. patent application Ser. No. 08/583,732, entitled "METHOD FOR FORMING TONER IMAGES WITH TWO DISTINCT TONERS," to E. C. Stelter et al, filed Jan. 17, 1996 discusses the problem of "scavenging" of first image toner into the second station. This is a problem well documented in prior DAD-DAD imaging systems. The Stelter et al application suggests substantial reduction in scavenging in a DAD-CAD process when the second station uses the same magnetic brush toning station disclosed in the Mosehauer patent. This application also discusses a problem associated with line images having a tendency to lose their resolution. This problem is solved according to this application by making the second exposure from the side of the image member opposite that containing the first toner image to discharge the first toner image to a level substantially below that of the untoned portions (which also helps reduce scavenging). This resolution problem can be termed "disruption" of the first toner image by the second exposure.

U.S. patent application Ser. No. 08/654,953, filed in the name of Richard Allen, the contents of which are incorporated herein by reference, notes that a successful DAD-CAD system for general use must generally deal with two different toners having varying responses to varying ambient conditions. It is well known that the charge-to-mass ratio (sometimes just called the "charge" or "relative charge") of many toner particles in two-component mixtures varies substantially with variations in relative humidity, temperature and other conditions. A higher charge-to-mass (Q/M) provides lower density for a given amount of surface potential in developing an electrostatic image. Variations in humidity not only occur seasonally, but, more seriously, occur daily. A high volume image forming apparatus may take two to three hours to reach a steady temperature after being turned on. This can result in a 30 percent change in relative humidity over a period in which many images are normally made. It is well known to analyze a developed toner patch with a densitometer to determine the image density at a particular voltage level which, in turn, can be used to estimate the charge on the toner.

A further complication that can be added to such systems is a desire for extremely high quality imaging using multilevel exposure, commonly called "gray level" exposure or imaging. Gray level imaging requires more voltage space in which to provide the various levels than does binary imaging, which further complicates problems associated with scavenging and disruption.

According to Allen, optimum density in conditions of varying toner charge (Q/M) while minimizing scavenging and disruption in a DAD-CAD system can be accomplished by a method of control which optimizes the development or toning completion of each image.

According to a preferred embodiment as taught by Allen, in a DAD-CAD system, less development completion is provided in toning the first image than in toning the second image. Preferably, the development completion of the first electrostatic image is kept below 0.4, even more preferably, below 0.3. This provides more voltage room to both develop the second toner image and to provide potential to resist scavenging. Such developer completion is provided primarily by providing a different pole transition rate in developing the two electrostatic images using a development system of a type similar to that described in the above Mosehauer et al patent. According to another preferred embodiment of Allen, development completion is varied by varying an AC component to a development field.

In another preferred embodiment, the original charge on the image member is varied, primarily to control density in the first (DAD) toner image in conditions of changing Q/M.

Although possible, Allen notes that it is not usually practical to measure directly the charge-to-mass ratio of toner in an electrophotographic apparatus. However, it can be determined indirectly by toner image density observations. Therefore, this process control, like other process controls well known in the art, is best operated with a control patch. Conventionally, a patch of photoconductive image member between image frames is charged and exposed to a particular level and then toned. The density of the toned patch is measured by a densitometer which then feeds that measurement back to logic and control and compares the density reading with a nominal density reading and adjusts the parameters of the system according to the difference. It repeats the monitoring of the control patch until the density is within a desired range. A separate patch is used for each of black and color toners. Although other parameters, such as toner concentration, can also affect patch density in a well controlled system it provides a reliable way of monitoring Q/M.

For example, if a reading on the black patch indicated that the density was too light, both $V_0$ and the AC bias on the first or black development station would be increased and the exposure from an electroluminescent trim panel (that is between the development stations) increased. If the color patch shows less density than desired, the electroluminescent (EL) trim panel can be decreased in output and the AC bias on the color development station increased. In this example, the pole transitions on the magnetic brush cores are constant but rotation of the core (and shell) could be made dependent upon the densitometer reading as well.

However, to avoid image defects such as scavenging and disruption of the black image by the color toning process, constraints must be imposed on the voltage levels of the DAD and CAD processes relative to each other. These constraints limit the range of the process control adjustments that can be applied to the usual process control knobs of primary charging ($V_0$) and toning station DC bias ($V_b$). As a consequence of these more limited adjustment ranges, the DAD-CAD process is more limited (compared to a single-mode process) in compensating variation in toning contrast. This smaller range of acceptable toning contrast makes the DAD-CAD process more prone to improper density and tone scale due to environmental extremes, rest-run effects, toner takeout and concentration extremes, etc.

To partially alleviate these limited adjustments, Allen discloses the adjustable AC bias utilized as an additional process control knob. The AC bias is adjusted independently in the black and the accent color toning stations, superimposed on the normal DC bias levels. In Allen, the black development station is preferably constructed to have a relatively slow rotation of its magnetic core, giving low toning percent completion, which in turn requires relatively high $V_0$. The variable AC bias provides adjustment of the nominally low percent completion of the black station. Allen specifies, according to toner charge-to-mass (Q/M), which direction to adjust the black process control parameters of $V_0$ and AC bias, as well as the accent process control parameters.

Allen indicates a constant post-exposure voltage ($V_e$) of 50 Volts for the black Dmax. $V_e$, it will be understood, is the charge level on the photoconductor measured after a $D_{max}$ exposure by say light from the black imaging exposure device. With a variable $V_0$, accurate regulation of $V_e$ would require precise automatic adjustment of light output from the black imaging exposure ($E_o$) device. Such adjustment, if open-loop, would require a prior accurate characterization of the photoconductor photoresponse to say driver current levels for producing different light output levels ($E_o$). A closed-loop adjustment of $E_o$ to regulate $V_e$ would require a post-exposure electrometer to measure $V_e$ and then change $E_o$ to maintain $V_e$ at 50V even though $V_o$ changes.

In the present invention, a simplified method of applying the three process control adjustments ($V_0$, $E_o$ and AC bias) for the black (DAD-mode) process is provided. The invention extends to 3 or 4 process control parameters a simplified method for 2 process control parameters ($V_0$ and $E_o$) disclosed by Rushing and Regelsberger in U.S. application Ser. No. 08/594,955. The third parameter, AC bias, has the special advantages for the DAD-CAD process as discussed above, in alleviating the problem of constrained $V_0$ and development station DC bias ($V_b$) adjustments. All three adjustments are in predetermined fixed ratio, from a predetermined starting point. The fourth adjustable parameter, delV, enables improved tone scale stability especially in the low density portion of the tone scale.

It is therefore an object of the invention to provide a process control method and apparatus particularly suited for an electrostatic image-forming process such as a DAD-CAD process which compensates well for tone scale shifts caused by changing environmental conditions and rest/run effects, requires fewer printed process control patches than other feedback strategies, reduces range requirements to compensate for any disturbances in say environmental conditions and avoids scavenging and disruption in the DAD-CAD process.

SUMMARY OF THE INVENTION

In accordance with one aspect of the invention, there is provided a reproduction apparatus comprising a reproduction apparatus comprising an electrostatic recording member for supporting an electrostatic image; a primary charger establishing a primary charge on the member, the primary charge being defined by a parameter $V_o$; an exposure device imagewise modulating the primary charge to form an electrostatic image on the recording member and having an exposure parameter $E_o$; a developer station developing the electrostatic image with charged toner, the developer station having an electrical bias to establish a field for urging movement of the toner to the member, the electrical bias having an alternating current component parameter AC; a controller controlling adjustments to the parameters $E_o$, $V_o$ and AC by measuring a density parameter $D_{OUT}$ of an exposed and developed area on the member that is formed by operation of said primary charger, said exposure device and said developer station, said controller including a calculator for calculating an error, $\Delta D_{OUT}$, in the measured density parameter from a density setpoint and multiplying $\Delta D_{OUT}$ by respective first, second and third constants to obtain respective adjustment values used for adjusting $E_o$, $V_o$ and AC and wherein in repeated use of said controller to provide repeated adjustment values used for adjusting $E_o$, $V_o$ and AC a fixed ratio is maintained between said first, second and third constants.

In accordance with another aspect of the invention, there is provided a method of controlling reproduction of images comprising the steps of: (a) charging an electrostatic recording member with a primary charge defined by a parameter $V_o$; (b) modulating the primary charge on the recording member with an exposure device to form an exposed test area, the exposure device having an exposure parameter $E_o$; (c) developing the exposed test area with charged toner using an electrical bias having an alternating current parameter AC; and (d) controlling adjustments to the parameters $E_o$, $V_o$ and AC by measuring a density parameter $D_{OUT}$ of the exposed and developed test area, calculating an error, $\Delta D_{OUT}$, in the measured density parameter from a density setpoint, and multiplying $\Delta D_{OUT}$ by respective first, second and third constants to obtain respective adjustment values used for adjusting $E_o$, $V_o$ and AC; and (e) repeating steps (a) through (d) to provide repeated adjustment values used for adjusting $E_o$, $V_o$ and AC wherein in the repeating of steps (a) through (d) a fixed ratio is maintained between said first, second and third constants.

In accordance with a third aspect of the invention, there is provided a reproduction apparatus comprising an electrostatic recording member for supporting an electrostatic image; a primary charger establishing a primary charge on the member, the primary charge being defined by a parameter $V_o$; an exposure device imagewise modulating the primary charge to form an electrostatic image on the recording member and having an exposure parameter $E_o$; a developer station developing the electrostatic image with charged toner, the developer station having a direct current electrical bias $V_b$ to establish a field for urging movement of the toner to the member; a controller controlling adjustments to the parameters $E_o$, $V_o$ and $delV=V_o-V_b$ by measuring a density parameter $D_{OUT}$ of an exposed and developed area on the member that is formed by operation of said primary charger, said exposure device and said developer station, said controller including a calculator for calculating an error, $\Delta D_{OUT}$, in the measured density parameter from a density setpoint and multiplying $\Delta D_{OUT}$ by respective first, second and third constants to obtain respective adjustment values used for adjusting $E_o$, $V_o$ and delV and wherein in repeated use of said controller to provide repeated adjustment values used for adjusting $E_o$, $V_o$ and delV a fixed ratio is maintained between said first, second and third constants.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention is described below in the environment of an electrophotographic copier and/or printer.

Because apparatus of the general type described herein are well known the present description will be directed in particular to elements forming part of, or cooperating more directly with, the present invention.

Figure 1:
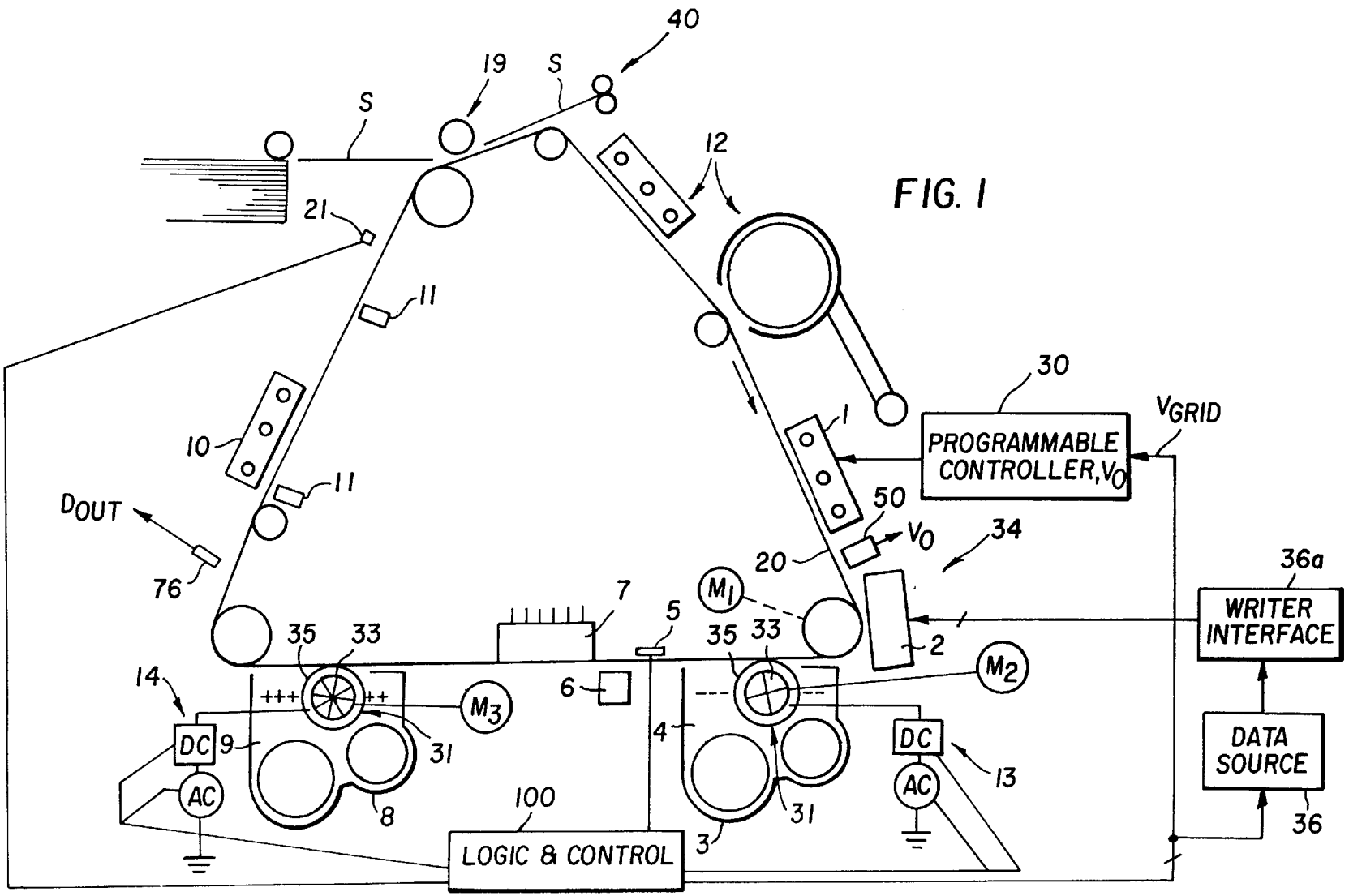
FIG. 1 is a schematic showing a side elevational view of an electrostatographic machine in which the present invention is useful.

FIG. 1 is a schematic of an image forming apparatus usable in a DAD-CAD process. Referring to FIG. 1, a moving photoconductive image member 20 is uniformly charged to a charge of a first potential $V_0$ by a primary charger 1. The member 20 is driven by a motor $M_1$ or other driver and is in the form of a belt or drum or other support. The output of the charger is regulated by a programmable controller 30, which is in turn controlled by a logic and control unit (LCU) 100 to adjust primary voltage $V_O$ for example through control of electrical potential ($V_{GRID}$) to a grid that controls movement of charged particles, created by operation of the charging wires, to the surface of the recording member as is well known. $V_o$ is measured on the image member 20 by electrometer 50.

For some embodiments, it is preferred that photoconductive image member 20 be transparent to the imaging exposing radiation. Although the charge could be either negative or positive, for illustrative purposes, it will be described as negative. The charged image member is imagewise exposed at an exposure station 34, for example, by an LED or laser printhead or write head 2, to create a first electrostatic latent image having a minimum potential $V_e$. At the exposure station 34, projected light from the write head dissipates the electrostatic charge on the photoconductive belt 20 to form a latent image of a document to be copied or printed. The light-emitting recording element(s) of the write head exposes the photoconductive belt picture element (pixel) by picture element with an intensity regulated in accordance with signals from the LCU to a writer interface 36*a* that includes a programmable controller. Alternatively, the exposure may be by optical projection of an image of a document or a patch onto the photoconductor. It is preferred that the same source that creates the patch used for process control to be described below also exposes the image information.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 36*a* for identifying exposure correction parameters in a look-up table (LUT) for use in controlling image density. In order to form patches with density, the LCU may be provided with ROM memory or other memory representing data for creation of a patch that may be input into the data source 36.

A toner of the first polarity, in this case negatively charged toner 4, is applied to the first electrostatic image by a development or toning station 3 in the presence of an electric field created between the station 3 and the image member 20 and controlled by a bias applied by a first source of potential 13 which is programmable and controlled with a programmable controller. The source of potential 13 preferably includes DC and AC components, with the DC component setting a development bias $V_b$ for first toning station 3. A controlled light source, for example, an EL trim panel 5, is positioned behind image member 20 (the side opposite the toner image) and is usable to trim the charge on the image member after the image member leaves the first toning station 3. The image member also passes under a conventional interframe and format erase device 6 positioned on the frontside of the image member 20.

The image member 20 is, again, imagewise exposed to form a second electrostatic image at an exposure station, for example, a second LED printhead 7, located on the side of the image member opposite the first toner image. (All of the functions of components 5 and 6 could alternatively be accomplished by printhead 7, but there are reliability advantages to separating them. In addition, the two printheads may be grey level printheads, as are well known, that is they are capable of varying light output in accordance with multibit image data to generate pixels of varying size or density. Examples of a grey level printheads are described in the patent literature. Such printheads can also vary light output in accordance with driver current adjustment such as for calibration. See, for example, U.S. application Ser. No. 08/581,025. The second electrostatic image has a minimum potential outside the first toner image $V_e'$. It is toned by the application of a second toner 9 of a second polarity (positive), opposite the first polarity, from a second development or toning station 8 in the presence of an electric field created between station 8 and the image member by a second source of potential 14 which is programmable and controlled by a programmable controller. The electric field includes a DC component or second bias $V_b'$, and can include an AC component, as shown. A second toner image is, thus, formed, which second toner image is of the second polarity and has a minimum potential $V_d'$.

As the image member 20 exits the second toning station 8, it contains a toner image containing two different types of toner on the same image frame area. Usually this image is a two color image in which the first toner is black and the second toner is a highlight or accent color such as red, yellow or blue. However, the process can be used with any color of toner in either station or even two toners of the same color to advantage. For example, the first toner could be a black, nonmagnetic toner and the second toner a black, magnetic toner for use in MICR systems.

The toner image contains toner of opposite polarities. A corona device 10 and erase lamps 11 are used to, as much as possible, change the toners to a single polarity so that they can be transferred at a transfer station 19 to a receiving sheet using normal electrostatic transfer forces. Alternatively, an intermediate member may have the image transferred to it and then the image may be transferred to the receiver. The receiving sheet, S, is separated from the image member, transported to a fuser 40 for fixing, and further fed into some sort of an output tray (not shown). The image member is cleaned, using a preclean charger and cleaning device 12 for reuse in the system. A logic and control 100 controls the system. The LCU provides overall control of the apparatus and its various subsystems, as is well known. Programming commercially available microprocessors is a conventional skill well understood in the art. The following disclosure is written to enable a programmer having ordinary skill in the art to produce an appropriate control program for such a microprocessor. In lieu of only microprocessors, the logic operations described herein may be provided by or in combination with dedicated or programmable logic devices.

Toning stations 3 and 8 are each constructed according to technology explained in more detail in U.S. Pat. No. 5,001,028, referred to above, which patent is hereby incorporated by reference herein. Briefly, each station includes an applicator 31 having a rotatable, magnetic core 33 within a shell 35 which also may be rotatable driven by respective motors $M_2$, $M_3$ or other suitable driving means. Toners 4 and 9 are part of a two component mixture (developer) including high coercivity (hard) magnetic particles. Rotation of the core and shell moves the developer through a development zone in the presence of the electrical field from sources of potential 13 and 14. Development completion of electrostatic images moving on image member 20 at any given speed is affected by the number of pole transitions in the development zone caused by the rotating core. This, in turn, is a function of both the number of poles in the core and its speed of rotation. As discussed in the aforementioned Allen application, low development completion in the first station and high development completion in the second station can be obtained by rotating the second core faster than the first or providing more poles on the second core. An adjustment in shell speed is useful to move the developer at the speed of the image member in both instances.

The concept of development completion may be explained by the following example as described by Allen. Assume in this example a black toner having a Q/M=−22.7 $\mu$C/g is the first toner and is placed in toning station 3 and a color toner having a Q/M=9.2 $\mu$C/g is placed in the second toning station 8. Both toners are mixed with a high coercivity carrier making a two component developer. The original voltage applied by charger 1, $V_0$ is equal to −450 volts. The darkest (intended) portions of the image are exposed to a minimum voltage $V_e$ of about 50 volts by printhead 2. Toning (development) is accomplished using a magnetic brush having a rotating core, as described above, which core is rotated at a speed providing 250 pole transitions per second in the first development zone. The magnetic brush is biased by source 13 to a direct current level $V_b$ of approximately −340 volts with no AC component. With these parameters, the first toning station 3 has a total toning potential $V_e - V_b$ equal to −290 volts. With the image member moving at a speed of 0.4375 meters per second (17.5 inches per second), the minimum voltage areas of the image are toned up to a potential $V_d$ of about −150 volts. The completion of toning or development is equal to $$\frac{V_d - V_e}{V_b - V_e},$$

in this case 0.35.

For the color image, the voltage $V_0'$ in the unexposed areas entering the second exposure station remains equal to $V_0$ (ignoring dark decay for simplicity of explanation) at −450 volts. The color image is exposed for CAD development with the expected background, or white areas, exposed down to a minimum potential $V_e'$ of about −130 volts. Because this exposure is through the base, it also reduces the voltage on the black image to a very low level $V_{de}$ of approximately −30 volts. Another portion of the black image is not exposed in this step because of an overlap (generally not intended) of the black and color images. This portion of the black image remains at $V_d$ after the color exposure. Extremely high quality registration of the images may eliminate this overlap, but usually it must be allowed for.

Using a magnetic brush toning station 8 essentially the same as that used in station 3 with the DC bias, $V_b'$, set at about −220 volts and a positive color toner having a Q/M equal to 9.2, a development completion of 0.67 can be obtained, bringing the voltage $V_d'$ in the most dense or highest potential areas of the color image down to about −300 volts.

The success of the control of this system can be analyzed in terms of resistance to some of the problems discussed above, including scavenging and disruption, as well as in terms of maintaining desired density despite varying toner Q/M. Scavenging is best analyzed by comparing the voltage in the overlap portion, $V_d$ with the bias $V_b'$ in the second development station. This potential difference $V_b' - V_d$ resists both overtoning and scavenging where it is most likely to occur. It is preferred that it be in excess of 50 volts which will effectively prevent scavenging. However, it must still permit sufficient development latitude for a range of densities in the color image. In the example with Q/M's as described, the scavenging potential is 69 volts which is adequate to prevent an unacceptable amount of scavenging. The color toning potential ($V_0' - V_b'$) is 230 volts, which is also adequate for gray level imaging with a high development completion in the color toning step.

The disruption potential is calculated as the difference between $V_{de}$ and $V_e'$. This potential difference prevents the black image from migrating or jumping into the white space adjacent it after the color exposure brings the adjacent areas down toward the black voltage level. In the example in question, the disruption potential is 96 volts, which is adequate to maintain an undisrupted black image. At the same time, the density of the black image is 1.15, and that of the color image is 1.05, which is acceptable maximum density for these images in gray level imaging.

Allen teaches that to maintain comparable density in the color toner step (while maintaining a relatively low $V_b'$), the voltage on the image member is reduced after the black toning step by exposure to electroluminescent trim panel 5. In the black image areas, the residual charge on the image member from black image exposure, $V_e$, plus the charge from the charged toner deposit create a field $V_d$ which is further reduced when exposed from the side of the image member opposite the first image.

While the trim exposure is preferred to be accomplished by the EL panel 5 on the backside of the image member 20, this trim could be readily built into the exposure values of printhead 7, thereby eliminating the backside EL panel. For given higher black Q/M to achieve good black density, higher $V_o$ is used, for example, −550 volts or −650 volts.

The DAD-CAD system is made more robust by construction or set up with low development completion in the first toning station and high development completion in the second station. To accomplish this aspect of the invention, the toning completion $$\frac{V_d - V_e}{V_b - V_e}$$

for the first station (the black image) should be less than 0.4, and preferably less than 0.3, for most Q/M values of the black toner. Although other means can be used, in the preferred embodiments, this is accomplished by a fixed lower pole transition rate in the first station than in the second station. This provides room in the potential graph for the color image formation and for a scavenging resisting potential $V_b'-V_{del}$ wherein $V_{del}$ is the potential in an image overlap portion after a trim exposure by EL panel 5. AC bias increase is used to increase lo development completion to control density in high Q/M situations.

This is a different use of development completion and has a tendency to cramp the voltage provided by the low pole transitions in the first station, but it is useful in expanding system use into difficult high Q/M situations.

Since resistance to scavenging is affected by the bias $V_b'$ in the second toning station 8, having $V_b'$ relatively high is useful. For this reason, a high development or toning completion in the second station is desirable. Ideally, the development completion of the second image is at least twice that of the first. The toning or development completion of the second toning step is equal to $$\frac{V_0' - V_d'}{V_0' - V_b'}$$

and should be greater than 0.6, preferably greater than 0.7 for most Q/M values of the color toners. Using pole transitions, it is preferable that the number of pole transitions to which the developer is subjected in applying the first toner is less than 60 percent that in applying the second toner.

Process control strategies generally utilize various sensors to provide real-time control of the electrostatographic process and to provide "constant" image quality output from the user's perspective.

One such sensor may be a densitometer 76 to monitor development of test patches in non-image areas of photoconductive belt 20, as is well known in the art. The densitometer is intended to insure that the transmittance or reflectance of a toned patch on the belt is maintained. The densitometer may consist of an infrared LED which shines through the belt or is reflected by the belt onto a photodiode. In the preferred embodiment, the patch nominal density is at the high density ($D_{MAX}$) end of the tone scale, and the densitometer is of the transmission type. A densitometer signal with high signal-to-noise ratio is obtained in the preferred embodiment, but a lower nominal density level and/or a reflection densitometer would be reasonable alternatives in other configurations. The photodiode generates a voltage proportional to the amount of light received. This voltage is compared to the voltage generated due to transmittance or reflectance of a bare patch, to give a signal representative of an estimate of toned density. This signal $D_{OUT}$, may be used to adjust $V_o$, $E_o$, $V_b$ and/or AC bias; and to assist in the maintenance of the proper concentration of toner particles in the developer mixture.

In the preferred embodiment, the density signal is used to detect short term changes in density of a measured patch formed using an exposure by exposure device 2 and developed with toner from development station 3 to control primary voltage $V_o$, exposure $E_o$, and/or D.C. development bias voltage $V_b$ and/or AC development bias. To do this, $D_{OUT}$ is compared with a set point density value or signal $D_{OUTSP}$ and differences between $D_{OUT}$ and $D_{OUTSP}$ cause the LCU to change settings of $V_{GRID}$ on charging station 2 and adjust exposure $E_o$ through modifying exposure duration or light intensity for recording a pixel by the first exposure device 2. Adjustment to the potential $V_b$ at the development station 4 is also provided for. These changes are in accordance with the invention described below.

Figure 4:
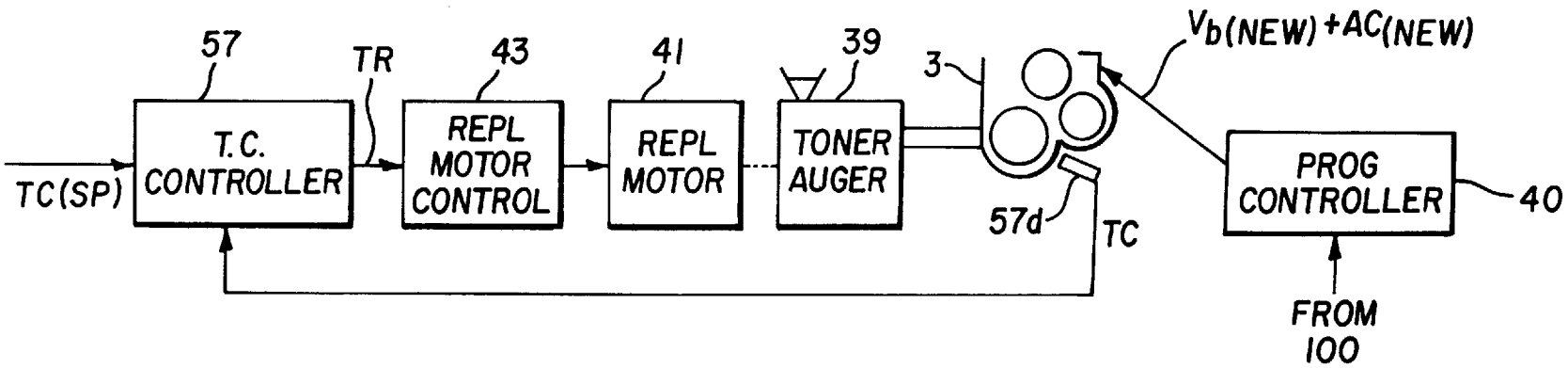
FIG. 4 is a schematic of controls for use in the apparatus of FIG. 1 for controlling replenishment of a development station.

In accordance with the invention described in commonly assigned U.S. application Ser. No. 60/002,661, filed Aug. 22, 1995 in the names of Rushing et al, long-term changes in toning contrast may be compensated for by adjustment of the toner concentration setpoint TC (SP) of a toner concentration (TC) controller 57 (see FIG. 4). The TC controller, in turn, adjusts the short term rate of toner replenishment. In a two-component developer provided in development or toning station 4, toner gets depleted with use whereas magnetic carrier particles remain thereby affecting the toner concentration in the development station. Addition of toner to the development station may be made from a toner replenisher device 39 that includes a source of toner and a toner auger for transporting the toner to the development station. A replenishment motor 41 is provided for driving the auger. A replenishment motor control circuit 43 controls the speed of the auger as well as the times the motor is operating and thereby controls the feed rate and the times when toner replenishment is being provided. Typically, the motor control 43 operates at various adjustable duty cycles that are controlled by a toner replenishment signal TR that is input to the replenishment motor control 43. Typically, the signal TR is generated in response to a detection by a toner monitor of a toner concentration that is less than that of a set point value. For example, a toner monitor probe 57*d* is a transducer that is located or mounted within or proximate the development station and provides a signal TC related to toner concentration. This signal is input to a toner monitor which in a conventional toner monitor causes a voltage signal $V_{MON}$ to be generated in accordance with a predetermined relationship between $V_{MON}$ and TC. The voltage $V_{MON}$ is then compared with a fixed voltage of say 2.5 volts which would be expected for a desired toner concentration of say 10%. Differences of $V_{MON}$ from this fixed voltage are used to adjust the rate of toner replenishment or the toner replenishment signal TR. In a more adjustable type of toner monitor such as one manufactured by Hitachi Metals, Ltd., the predetermined relationship between TC and $V_{MON}$ offers a range of relationship choices. With such monitors, a particular parametric relationship between TC and $V_{MON}$ may be selected in accordance with a voltage input representing a toner concentration set point signal value, TC(SP). Thus changes in TC(SP) can affect the rate of replenishment by affecting how the system responds to changes in toner concentration that is sensed by the toner monitor.

While the above approach suggested for the control of toning contrast by control of toner concentration works well to gradually compensate the long-term effects of developer aging, the invention described herein is directed to compensating short-term environmental changes and rest/run effects by control of $V_o$, $E_o$ and DC bias $V_b$, and AC bias and is sufficiently robust as to be usable with other techniques for controlling toning contrast and for controlling toner concentration.

Figure 2:
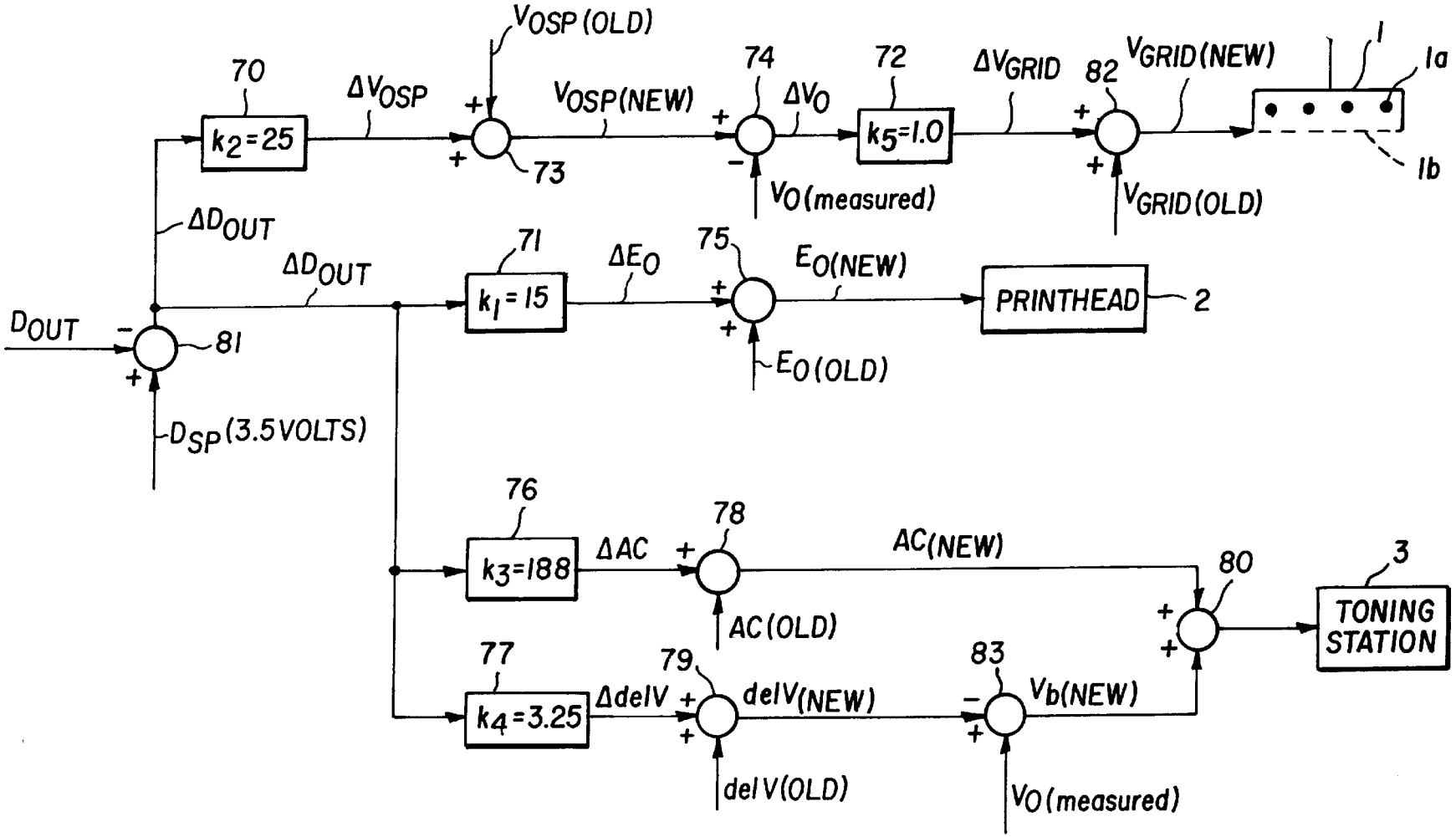
FIG. 2 is a schematic of an algorithm for control of $V_o$, $E_o$ and development station bias in the apparatus of FIG. 1.

With reference now to FIG. 1 and FIG. 2, there is shown a programmable controller for controlling parameters $V_O$, generated by the primary corona charger 1, and $E_o$ generated by the LED printhead 2 of FIG. 1 and bias potentials $V_b$ and AC of toning station 3. As is well known, control of $V_o$ is advantageously provided for by adjustment of the potential to a grid 1*b* in those primary chargers which employ such a grid. With such chargers, corona or charged ions generated by the corona wires 1*a,* which are at an elevated potential level, are caused to pass through the grid to an insulating layer on the photoconductor, which photoconductor is otherwise grounded. The charge level builds on this insulating layer to a level proximate that of the potential on the grid. Thus $V_{GRID}$, the potential on the grid, provides a reasonably close correspondence to the primary charge $V_o$ created on the photoconductor. Other primary chargers that do not employ a grid may also be used. Control of $E_o$ is preferably made by control of current to an electronic exposure source such as LED printhead 2. Other electronic exposure devices such as lasers, other electro-optical exposure devices, optical exposure devices may also be used. Examples of LED printheads are described in U.S. Pat. Nos. 5,253,934; 5,257,039 and 5,300,960 and U.S. application Ser. No. 08/581,025, filed Dec. 28, 1995 in the names of Michael J. Donahue et al and entitled "LED Printhead and Driver Chip For Use Therewith Having Boundary Scan Test Architecture" and Ser. No. 08/580,263, filed Dec. 28, 1995 in the names of Yee S. Ng et al and entitled "Apparatus and Method for Grey Level Printing with Improved Correction of Exposure Parameters." In the references just described, there are illustrated examples of LED printheads which are formed of plural chip arrays arranged in a single row. Typically, 64, 96, 128 or 196 LEDs are arranged on a chip array in a row and when the chip arrays are in turn arranged on a printhead support, a row of several thousand LEDs is provided that is made to extend across, and preferably perpendicular, to the direction of movement of the photoconductor. Desirably, the number of LEDs (typically five to six thousand) are such so as to extend for the fall width or available recording width of the photoconductor so that the LED printhead may be made stationary. The LEDs are typically fabricated to be pitched at 1/300th or better yet 1/600th to the inch in the cross-track dimension of the photoconductor. Control of current and selective enablement is provided by driver chips that are also mounted on the printed. Typically, one or two driver chips are .associated with each LED chip array to provide a controlled amount of current to an LED selected to record a particular pixel at a particular location on an image frame of the photoconductor. Since LED printing is conventional, further details are either well known or may be obtained from the aforementioned references. In control of current to each LED for recording a pixel, the above patent literature notes that two parameters may be used. One of the parameters referred to in this literature has to do with a global adjustment parameter or capability for the LED printhead. With a global adjustment capability, which we may call "$G_{REF}$" (also known in the patent literature as $V_{REF}$) there is provided the ability to change by a certain amount current generated by the driver chips for driving LEDs selected to be enabled. The LED printheads disclosed in the above patent literature may also have a local adjustment capability ($L_{REF}$) that may be used to adjust current generated by some driver chips differently than current generated by others. The reasons for providing both global and local current adjustment capability is that LED driver chips and LEDs on certain chips may vary from batch to batch due to process differences during manufacture. When the LED printhead is manufactured, these process differences may be accommodated for by allowing selection of different currents generated by different driver chips on the same printhead. In addition, if a printhead while in use has temperature differentials on the printhead, provision may be made for controlling current to a different extent for each driver chip. However, due to aging of the printhead and/or changes in electrophotographic process conditions, global changes to driver current are advantageously provided for in order to change the parameter $E_o$. In a system which employs discharge area development, exposure of a pixel area by an LED will cause that pixel area to be developed. The more the exposure, the greater the density until an exposure is provided that provides a maximum development capability. Thus, for example, to create a patch of density $D_{MAX}$, a block of many LEDs similarly illuminated can create an exposed patch area on the photoconductive belt 20.

Figure 3:
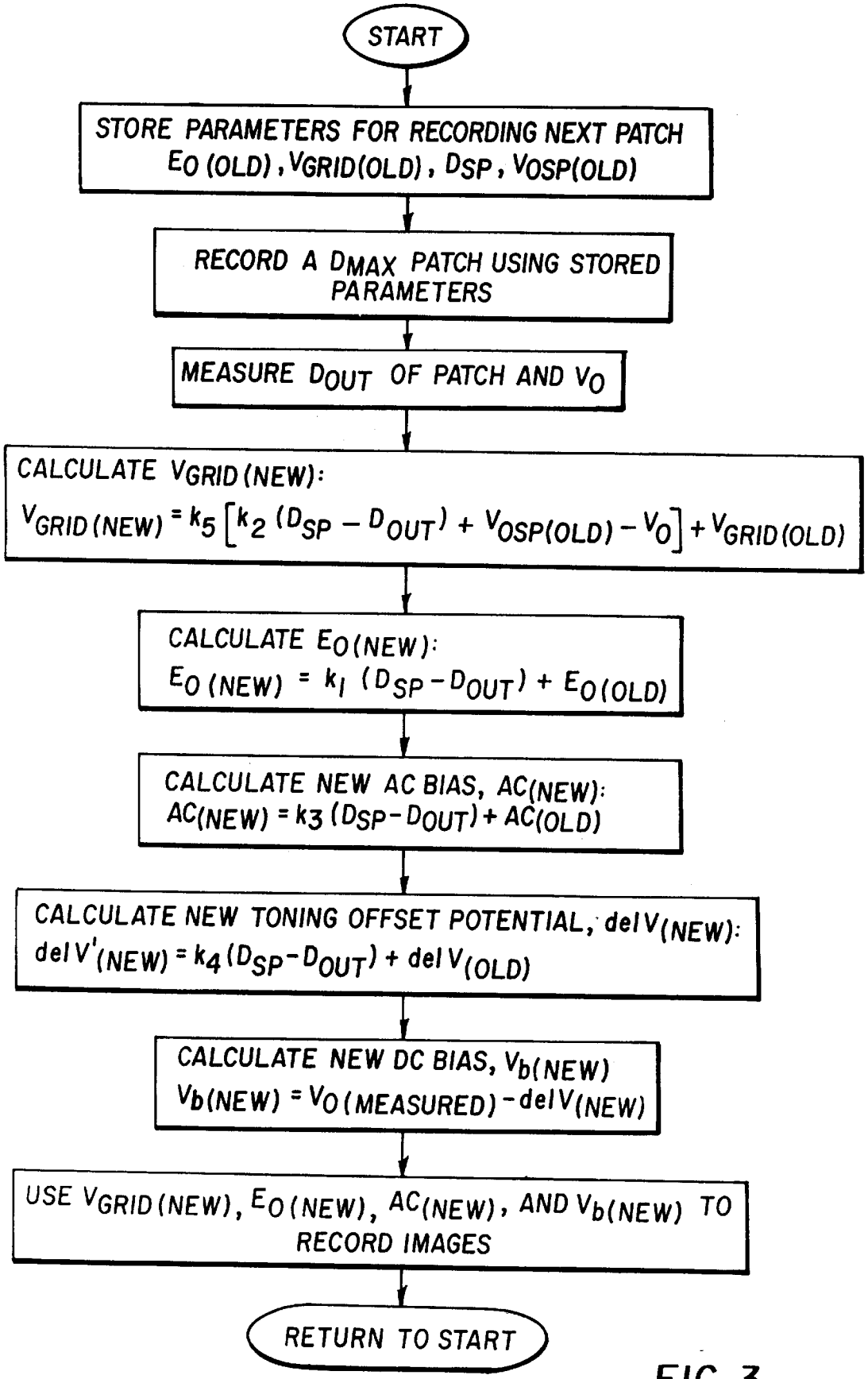
FIG. 3 is a flowchart of a program operative for determining new values of $V_o$, $E_o$ and development station bias during operation of the apparatus of FIG. 1.

With reference now to FIGS. 2 and 3, the apparatus of FIG. 1 under control of the programmed logic and control unit 100 causes a calibration mode to be entered every few image frames; for example, every 5 or 6 image frames. In this mode, parameters used for recording a next set of patches each of $D_{MAX}$ density or of other suitable density are stored in memory. The set of patches may be in an interframe area on the photoconductor and several patches may be recorded, using exposure station 2 and development station 3, throughout the width of the photoconductor to ensure similar operation of selected groups of LEDs. The typical parameters of interest are $E_o$, $V_{GRID}$, $D_{SP}$ (set point associated with densitometer output at toned patches of maximum density; i.e. patches of $D_{MAX}$ and is typically is 3.5 volts when the transmission densitometer output is measured and a deduction taken for losses through the transparent photoconductor). After a $D_{MAX}$ patch or set of $D_{MAX}$ patches is recorded, $D_{OUT}$ of the patch and $V_o$ on the photoconductor in a non-exposed area are measured. The difference between a signal representing $D_{OUT}$ and a signal representing $D_{sp}$ are used to generate an error signal $\Delta D_{OUT}$ by a comparator 81. In accordance with the invention, this error signal is multiplied in respective multipliers 70, 71, 76 and 77 by four respective constants $k_1$, $k_2$, $k_3$ and $k_4$ having a fixed ratio, in this example, $k_2/k_1/k_3/k_4$=25/15/188/3.25. Also, in the preferred example, $k_2$=25 and $k_1$=15, $k_3$=188 and $k_4$=3.25. For adjustments to $V_o$, multiplying of $\Delta D_{OUT}$ by 25 indicates a needed change to the $V_o$ set point print $V_{OSP}$ and identified as $\Delta V_{OSP}$. The change in $V_{OSP}$, $\Delta V_{OSP}$ is then added to (or if a negative change subtracted from) $V_{OSP}$ used to create the patch ($V_{OSPOLD}$) to generate from adder 73 a new $V_o$ set point signal, $V_{OSP(NEW)}$.. The difference between a signal representing $V_{OSP(NEW)}$ and a signal representing measured $V_o$($V_{o(measured)}$) which is the present level of $V_O$ for the current image frame above the electrometer 50, generates an error signal $\Delta V_o$ generated by comparator 74. The value $V_{o(measured)}$ may be a single measurement or an average of readings over several image frames. The signal representing $\Delta V_o$ is multiplied by multiplier 72 with a parameter $k_5$; in this case, $k_5$=1.0 to transform a determined $\Delta V_o$ change to a corresponding grid voltage change of $\Delta V_{GRID}$. A signal representing $\Delta V_{GRID}$ is then added (or subtracted) to the grid voltage used to generate the patch $V_{GRID(OLD)}$ to create a new $V_{GRID(NEW)}$ voltage generated by adder 82 that may be used for recording the next few image frames until a further adjustment is indicated by routine repetition of this process through new electrometer readings using electrometer 50, creating of new patches, and new densitometer readings using densitometer 76, and wherein the present new parameter values become the old parameter values.

The signal output from multiplier 71 represents an adjustment in $E_o$ and is identified as $\Delta E_o$. A signal representing $\Delta E_o$ is added to (or subtracted from) a signal representing the $E_o$ value used to create the patch, $E_{o(OLD)}$. In this example, $E_o$ and $\Delta E_o$ are in terms of parameters used to generate current to the LEDs and more specifically $G_{REF}$ and $\Delta G_{REF}$, which is a change to the parameter $G_{REF}$. As noted in the above patent literature, a value $G_{REF}$ can be a digital value stored in a register on each of the driver chips. This digital value is used to enable certain transistors to control levels of current generated in a current generating circuit of the driver chips. Preferably, the values $G_{REF}$ and $L_{REF}$ (also referred to in the patent literature as $R_{REF}$), through selective enablement of certain transistors, control current generated in a master circuit wherein the LED driver channels are driven by slave circuits that are slaved off the master circuit. However, the value $E_o$ is shown generally in FIG. 2 because the invention has broader applicability to other printers or exposure sources that do not use values of $G_{REF}$ to control $E_o$ and might even feature analog control of $E_o$, or as noted above, could be from an optical exposure. The signal representing $\Delta E_o$ is added to the value of $E_{o(OLD)}$ (or $G_{REF(OLD)}$ specifically) used to create the patch to generate from adder 75 a signal representing a new value $E_o$ or $E_{o(NEW)}$ to be used along with the new value of $V_{GRID}$ or $V_{GRID(NEW)}$ for recording the next few image frames for making copies or producing prints until the control process is repeated for producing adjustments thereto.

The signal $\Delta D_{OUT}$ is also input to multipliers 76 and 77 for direct current associated with controls for the voltage potential source 13 for regulating the direct current (DC) $V_{bias}$ and the alternating current (AC) bias on development or toning station 3. For regulating AC bias the signal $\Delta D_{OUT}$ is multiplied by a constant $k_3$=188 by multiplier 76 to obtain a signal ΔAC. This signal ΔAC depending on sign; i.e., + or −, is added by adder 78 to the signal $\Delta C_{OLD}$ used to generate the measured patch. Adder 78 outputs the sum as an adjusted AC bias signal, $\Delta C_{NEW}$ as the new alternating voltage biasing potential for biasing the toning station's development electrode.

The signal $\Delta D_{OUT}$ is multiplied by a constant $k_4$=3.25 by multiplier 77 to obtain a value ΔdelV. The term "delV" comprises a parameter representing a difference between $V_o$ and $V_b$ or $V_o-V_b$ wherein $V_b$ is the DC component of the bias to the toning station 3. The term "ΔdelV" represents a change in del V. A signal representing a value for "ΔdelV" is output by multiplier 77 and added at adder 79 to a previous setting for $delV_{(old)}$ which was used to form the patch. The sum is a signal representing $delV_{(NEW)}$ which is input to the negative input of adder 83. Another input to adder 83 is $V_{o(measured)}$ which is the level of primary charge level measured which is on the present image frame passing the electrometer 50 or an average of recent electrometer readings over plural image frames. The present value of $V_{o(measured)}$ can be fed forward to generate the new DC voltage level bias $V_{b(NEW)}$ on the toning station 3. The DC level bias, $V_{b(NEW)}$ is added to the signal $AC_{(NEW)}$ at adder 80 which forms part of the programmable voltage supply and controller 40 to form the new bias signal to the toning station 3. This new bias signal commences when the image frame used to measure or determine $V_{o(measured)}$ is at the development station for development of the electrostatic image recorded by printhead 2. Note that $V_{o(measured)}$ may be an average reading of nonexposed areas for example in interframes or other areas of one or more frames. The present value of $V_{o(measured)}$ as determined for each image frame above the electrometer or as determined as an average of recent readings is used to continually adjust $V_{GRID(NEW)}$. In this regard, adjustments to $V_{GRID(NEW)}$ do not occur within an image frame area since a uniform charge level is desired within the image frame for the primary charge level.

In FIG. 3, a flowchart of a program is illustrated identifying an equivalent calculation which can be made by either using software or hardware calculators. Densitometer measurements of a $D_{max}$ patch, along with electrometer measurements of $V_o$, are used to calculate adjustments for $V_{GRID}$, $E_o$, AC and $V_b$. The new DC voltage bias to toning station 3, $V_{b(NEW)}$ is generated by the relationship of $V_{b(NEW)}=V_{o(measured)}-delV_{(NEW)}$. In the prior art delV is generally held constant, but in the present invention delV is adjusted as described previously to achieve superior tone scale regulation.

From a starting point of $V_0$=550, Gref=150, and AC=750, an adjustment ratio of $\Delta V0/\Delta E_o/\Delta AC$=25/10/188 is found experimentally to provide good tone scale stability, in a laboratory configuration, over environmental and rest-run extremes when delV is held constant. The numbers in this ratio are multiplied by the deviation of the densitometer voltage output from the voltage corresponding to the Dmax setpoint, yielding the three process control adjustments to apply, adding or subtracting to the current values of $V_o$, Gref, and AC. The effect of the adjustments on Dmax is monitored by the densitometer, and any remaining deviation drives the next iteration in the adjustment process. The iterations are repeated until the measured deviation from setpoint is sufficiently small, and in any event repeated frequently enough to compensate for process drift owing to environmental effects, etc. The post-exposure film voltage $V_e$ a resulting from this strategy is not constant, but rather a relatively high $V_e$ when V0 is high, and low $V_e$ when V0 is low.

The simplification eliminates the need for having an extensive look-up table (LUT) or complicated mathematical model of the electrophotographic process to determine process control adjustments. Such a LUT or model is difficult to derive accurately, especially a model that accounts for aging and rest-run effects. Any particular LUT or model would likely apply only to a specific set of materials in a specific machine configuration. A further advantage is that the adjustments are directly proportional to measured deviation of toned density from setpoint, without any requirement to infer Q/M, as in U.S. application Ser. No. 08/654,953. Nor is there any need for a post-exposure electrometer. Thus, the electrometer may be positioned to measure $V_o$ before or after the printhead.

Further improvement in tone scale stability is obtained by utilizing a toning offset potential, $delV=V_0-V_b$, as a fourth process control knob as shown in FIG. 2 along with the other three ($V_0$, $E_o$ and AC bias). The delV value was held constant in the process control systems described in U.S. application Ser. Nos. 08/654,953 and in 08/594,955. The concept of a predetermined fixed ratio of adjustments is extended to these 4 process control adjustments. In a laboratory configuration a fixed ratio of $\Delta V_0/\Delta Gref/\Delta AC/\Delta delV$=25/15/188/3.25 provided excellent tone scale stability, with significant improvement in the low-density steps, compared to the three parameter control scheme. It may be noted that in the three knob configuration, the constant $k_1$ is different from that used in the four knob configuration. FIG. 2 shows the structure and connections of the measured and adjusted parameters in block diagram form. FIG. 3 shows a corresponding logic flow chart for determining new values for $V_o$, Gref, AC, and delV.

There has thus been provided an improved process control method and apparatus wherein superior compensation is provided for tone scale shifts caused by changing environmental conditions and rest-run effects. An iterative feedback control system provides robustness over machine-to-machine and batch-to-batch variations. Iteration also compensates for process drift with aging. The control requires only $D_{max}$ process control patches to stabilize the entire tone scale and reduces the adjustment range requirements to compensate any given (e.g. environmental) disturbance, compared to the range required when only one or two process control parameters are adjusted. Scavenging and disruption in the DAD-CAD process is minimized by applying relatively modest process control adjustments to 3 or 4 parameters ($V_0$, Gref, AC, and delV), rather than a large adjustment to only one (say $V_o$) or two (say $V_o$ and $G_{ref}$).

Furthermore, as noted above, there is no requirement for an extensive look-up table or complicated mathematical model of the electrophotographic process to compute adjustments and no requirement to infer a developer Q/M value; not from density measurements and process control settings nor by any method whatever.

While patch creation mode may be done, say every 6, 10 or 100 image frames depending on process stability during periods of rapid process drift, such as the first startup of the day at high relative humidity, more frequent process control patch modes could be needed. Depending on the configuration, skip frames may be required with the process control patches, with corresponding reduction in productivity.

Of course, different configurations may require different predetermined ratios of the $V_o$, $E_o$, AC bias, and delV adjustments that produced adjustments to $V_b$.

The invention is described by way of example for use preferably in a DAD-CAD process; however, the invention in its broader aspect may be used in other types of processes for electrostatically producing an image or images including processes wherein only one color image is produced on an image frame.

The invention has been described in detail with particular reference to preferred embodiments thereof and illustrative examples, but it will be understood that variations and modifications can be effected within the spirit and scope of the invention.

We claim:

1. A reproduction apparatus comprising:

an electrostatic recording member for supporting an electrostatic image;

a primary charger establishing a primary charge on the member, the primary charge being defined by an adjustable parameter $V_o$;

an exposure device imagewise modulating the primary charge to form an electrostatic image on the recording member and having an adjustable exposure parameter $E_o$;

a developer station developing the electrostatic image with charged toner, the developer station having an electrical bias to establish an electrical field for urging movement of the toner to the member, the electrical bias having an adjustable direct current component $V_b$ and an adjustable alternating current component parameter AC;

a controller controlling adjustments to the parameters $E_o$, $V_o$ and AC by measuring a density parameter $D_{OUT}$ of an exposed and developed area on the member that is formed by operation of said primary charger, said exposure device and said developer station, said controller including a calculator for calculating an error, $\Delta D_{OUT}$, in the measured density parameter from a density setpoint and multiplying $\Delta D_{OUT}$ by respective first, second and third constants to obtain respective adjustment values used for adjusting $E_o$, $V_o$ and AC and wherein in repeated use of said controller to provide repeated adjustment values used for adjusting $E_o$, $V_o$ and AC a fixed ratio is maintained between said first, second and third constants.

2. The apparatus of claim 1 wherein the adjustment value for $V_o$ represents a change in a set point of $V_o$.

3. The apparatus of claim 2 wherein the change in the set point of $V_o$ is used to adjust a voltage potential on a grid of the primary charger.

4. The apparatus of claim 3 wherein the adjustment value for $E_o$ is used to adjust a current to an electronic exposure element on said exposure device.

5. The apparatus of claim 1 wherein the developer station is a first developer station and including a second development station for developing a second electrostatic image in registration on an image frame together with a developed electrostatic image developed by the first developer station.

6. The apparatus of claim 1 wherein the controller multiplies $\Delta D_{OUT}$ by a respective fourth constant to obtain adjustment values used for adjusting $V_b$.

7. A method of controlling reproduction of images comprising the steps of:

(a) charging an electrostatic recording member with a primary charge defined by an adjustable parameter $V_o$;

(b) modulating the primary charge on the recording member with an exposure device to form an exposed test area or set of test areas, the exposure device having an an adjustable exposure parameter $E_o$;

(c) developing the exposed test area or set of test areas with charged toner using an electrical bias having an adjustable direct current component $V_b$ and an adjustable alternating current parameter AC to establish an electrical field urging movement of toner to the member; and (d) controlling adjustments to the parameters $E_o$, $V_o$ and AC by measuring a density parameter $D_{OUT}$ of the exposed and developed test area or set of test areas, calculating an error, $\Delta D_{OUT}$, in the measured density parameter from a density setpoint, and multiplying $\Delta D_{OUT}$ by respective first, second and third constants to obtain respective adjustment values used for adjusting $E_o$, $V_o$ and AC; and (e) repeating steps (a) through (d) to provide repeated adjustment values used for adjusting $E_o$, $V_o$ and AC wherein in the repeating of steps (a) through (d) a fixed ratio is maintained between said first, second and third constants.

8. The method of claim 7 wherein the adjustment value for $V_o$ represents a change in a set point of $V_o$ and wherein the change in the set point of $V_o$ is used to adjust a voltage potential on a grid of a primary charger for charging the member.

9. The method of claim 8 wherein the adjustment value for $E_o$ is used to adjust a current to an electronic exposure element that is used to produce an image.

10. The method of claim 7 and after adjusting $V_o$, $E_o$ and AC adjusted values of $V_o$, $E_o$ and AC are used to produce an image.

11. The method of claim 7 and including multiplying $\Delta D_{OUT}$ by a respective fourth constant to obtain adjustment values used for adjusting $V_b$.

12. The method of claim 11 and including forming an electrostatic image and developing the electrostatic image in registered relationship on the same image frame with the image produced using parameters $V_o$, $E_o$, AC and $V_b$.

13. The method of claim 7 and wherein the area or set of areas are formed to be of only one target density level and adjustment values used for adjusting $E_o$, $V_o$ and AC are determined from only a developed test area or set of test areas of the one target density level.

14. The method of claim 13 and wherein the single target density level is $D_{MAX}$.

15. A reproduction apparatus comprising:

an electrostatic recording member for supporting an electrostatic image;

a primary charger establishing a primary charge on the member, the primary charge being defined by a parameter $V_o$;

an exposure device imagewise modulating the primary charge to form an electrostatic image on the recording member and having an exposure parameter $E_o$;

a developer station developing the electrostatic image with charged toner, the developer station having a direct current electrical bias $V_b$ to establish an electrical field for urging movement of the toner to the member;

a controller controlling adjustments to the parameters $E_o$, $V_o$ and $delV=V_o-V_b$ by measuring a density parameter $D_{OUT}$ of an exposed and developed area or set of areas on the member that is formed to only a single target density level by operation of said primary charger, said exposure device and said developer station, said controller including a calculator for calculating an error, $\Delta D_{OUT}$, in the measured density parameter from a density setpoint for the single target density level and multiplying $\Delta D_{OUT}$ by respective first, second and third constants to obtain respective adjustment values used for adjusting $E_o$, $V_o$ and delV and wherein in repeated use of said controller to provide repeated adjustment values used for adjusting $E_o$, $V_o$ and delV a fixed ratio is maintained between said first, second and third constants and only a single target density level is used to form the area or set of areas to determine the respective adjustment values.

16. The apparatus of claim 15 wherein the developer station is a first developer station and including a second development station for developing a second electrostatic image in registration on an image frame together with a developed electrostatic image developed by the first developer station.

17. The apparatus of claim 15 and wherein the controller is operative to adjust the parameter $V_b$ as a feed-forward response to measurement of the parameter $V_o$ on the recording member wherein the measurement of the parameter $V_o$ on the recording member represents an operation of the primary charger after adjustment of the primary charge parameter $V_o$ by measuring said density parameter Dour of said exposed and developed area or set of areas on the member.

18. The apparatus of claim 15 and wherein the adjustment value for $V_o$ represents a change in a setpoint of $V_o$ and the controller is operative to calculate a new setpoint of $V_o$ by adding the adjustment value to a prior setpoint of $V_o$.

19. The apparatus of claim 18 and wherein the primary charger is a grid controlled charger and the controller adjusts a grid voltage in response to a comparison of a measurement of the parameter $V_o$ on the recording member and the new setpoint of $V_o$.

20. The apparatus of claim 19 and wherein the development station has an electrical bias having an alternating current component parameter AC and the controller is operative to generate an adjustment value to AC by multiplying $\Delta D_{OUT}$ by a fourth constant and the controller is operative to maintain a fixed ratio between the first, second, third and fourth constants during repeated use of the controller to provide repeated adjustment values used for adjusting $E_o$, $V_o$ and delV.

21. The apparatus of claim 15 wherein the target density level is $D_{MAX}$.

22. A method of controlling reproduction of images comprising the steps of:

(a) operating a primary charger to establish a primary charge on an electrostatic recording member, the primary charge being defined by a parameter $V_o$;

(b) imagewise modulating the primary charge with an exposure device to form an electrostatic image on the recording member, the exposure device having an exposure parameter $E_o$;

(c) developing the electrostatic image with charged toner by operating a developer station having a direct current electrical bias $V_b$ to establish a field for urging movement of the toner to the member;

(d) controlling adjustments to the parameters $E_o$, $V_o$ and $delV=V_o-V_b$ by measuring a density parameter $D_{OUT}$ of an exposed and developed area or set of areas on the member that is formed to only a single target density level by operation of said primary charger, said exposure device and said developer station, and calculating an error, $\Delta D_{OUT}$, in the measured density parameter from a density setpoint for the single target density level and multiplying $\Delta D_{OUT}$ by respective first, second and third constants to obtain respective adjustment values used for adjusting $E_o$, $V_o$ and delV and wherein in repeated use of said controller to provide repeated adjustment values used for adjusting $E_o$, $V_o$ and delV a fixed ratio is maintained between said first, second and third constants and only a single target density level is used to form the area or set of areas to determine the respective adjustment values.

23. The method of claim 22 wherein the adjustment value for $V_o$ represents a change in a set point of $V_o$ and wherein the change in the set point of $V_o$ is used to adjust a voltage potential on a grid of the primary charger for charging the member.

24. The method of claim 23 wherein the adjustment value for $E_o$ is used to adjust a current to an electronic exposure element that is used to produce an image.

25. The method of claim 22 and after adjusting $V_o$, $E_o$ and $V_b$ adjusted values of $V_o$, $E_o$ and $V_b$ are used to produce an image.

26. The method of claim 22 and including measuring the parameter $V_o$ on the recording member and adjusting the parameter $V_b$ in response to measurement of the parameter $V_o$ on the recording member wherein the measurement of the parameter $V_o$ on the recording member represents an operation of the primary charger after adjustment of the primary charge parameter $V_o$ by measuring said density parameter $D_{OUT}$ of said exposed and developed area of the member.

27. The method of claim 22 and wherein the adjustment value for $V_o$ represents a change in a setpoint of $V_o$ and the controller is operative to calculate a new setpoint of $V_o$ by adding the adjustment value to a prior setpoint of $V_o$.

28. The method of claim 27 and wherein the primary charger is a grid controlled charger and a grid voltage is adjusted in response to a comparison of a measurement of the parameter $V_o$ on the recording member and the new setpoint $V_o$.

29. The method of claim 20 and wherein the single target level density is $D_{MAX}$.

* * * * *